US005647728A

United States Patent [19]

Siebenwurst et al.

[11] Patent Number: 5,647,728

[45] Date of Patent: Jul. 15, 1997

[54] LIQUID RING MACHINE HAVING PIVOTED OUTER HOUSING

[75] Inventors: Robert Siebenwurst, Nuremberg; Hans Kuhn, Abenberg; Bernhard Tews, Altdorf, all of Germany

[73] Assignee: Siemens Aktiengesellschaft, Munich, Germany

[21] Appl. No.: 646,167

[22] Filed: May 7, 1996

[30] Foreign Application Priority Data

May 8, 1995 [DE] Germany ..... 195 16 836.4

[51] Int. Cl.[6] ..... F04C 19/00

[52] U.S. Cl. ..... 417/68

[58] Field of Search ..... 417/68, 219, 220

[56] References Cited

FOREIGN PATENT DOCUMENTS

| | | | |
|---|---|---|---|
| 531658 | 3/1921 | France | 417/68 |
| 323255 | 7/1920 | Germany | 417/68 |
| 335674 | 4/1921 | Germany | 417/68 |
| 4305424A1 | 8/1994 | Germany . | |
| 608984 | 5/1978 | U.S.S.R. | 417/68 |

*Primary Examiner*—Timothy Thorpe
*Assistant Examiner*—Roland G. McAndrews, Jr.
*Attorney, Agent, or Firm*—Kenyon & Kenyon

[57] ABSTRACT

An improved liquid ring machine having a housing that has a circular inside contour and side shields arranged at its faces, at least one of which is provided with a control disk. The rotor of the machine is eccentrically mounted in the side shields to rotate relative to the machine housing. The rotor comprises a hub, blades, and a center wall that extends radially over the entire circumference of the rotor from the rotor hub to the free end of the blades. A partition wall is attached to the machine housing, lies in the same plane as the center wall and surrounds the center wall such that a gap exists between the center wall and the partition wall. The gap may be easily adjusted by pivoting the machine housing relative to the side shields, i.e., the control disks, and the rotor, around a pivot point that lies outside of the center axis. The machine housing may be secured in place in its pivoted position in each instance. Use of this pivot point provides a more uniform change in gap between the center wall and partition wall, and adjustments to the partition wall are not necessary, thus permitting the machine housing and partition wall to be provided as a unitary element.

25 Claims, 5 Drawing Sheets

LIQUID RING MACHINE HAVING PIVOTED OUTER HOUSING

FIELD OF THE INVENTION

The invention relates generally to liquid ring machines and, more particularly, to an improved liquid ring machine in which the position of the rotor relative to the inside surfaces of the machine housing may be pivoted in a simple manner to adjust the gap between the rotor blades and the housing.

BACKGROUND OF THE INVENTION

Liquid ring machines are generally described in DE-A-43 05 424, which corresponds to U.S. application Ser. No. 08/505,228, the text of which is hereby incorporated by reference. In liquid ring machines, the position of the rotor relative to the inside contour of the machine housing has an effect on machine performance. Depending upon the circumferential velocity of the rotor, the pressure ratio of the machine, or its demand for working liquid, various installation positions of the rotor can result in better or worse machine performance. Further variations in machine performance may arise from dimensional tolerances present in the production technologies employed for their manufacture.

OBJECTS AND SUMMARY OF THE INVENTION

The present invention is directed to the problem of further developing a liquid ring machine in which the position of the rotor can be adjusted relative to the machine housing in a simple manner such that the machine achieves maximum performance.

Generally, the machine comprises a machine housing with a circular inside contour, and side shields arranged at its ends. A control disk is inserted between at least one side shield and the machine housing. The rotor of the machine is eccentrically mounted, i.e, along an axis that is offset from the center axis of the housing, in the side shields to rotate relative to the machine housing.

The invention provides for the machine housing to be pivotable relative to the side shields around a pivot point that lies offset from the center axis of the machine housing. When the desired position is obtained, the housing and side shields are secured to one another, thus maintaining the desired orientation. The ability to pivot the machine housing permits the relative position between the rotor and the inside contour of the machine housing to be adjusted in such a way that the maximum performance is obtained for a given set of operating conditions.

One of the advantageous design features of the invention is the use of a fixation mechanism that secures the machine housing in its pivoted position relative to the side shields. The fixation mechanism is located on the periphery of the machine housing and control disks. This location allows one to easily pivot the machine housing relative to the side shields.

Securing the machine housing in the desired position is simple. The fixation mechanism comprises one or more peg holes located in the control disks and machine housing and pins that can be inserted into them. Instead of locating only one peg hole in the control disk and one in the machine housing, it is preferred if several circumferentially spaced peg holes are located at least in the control disk or machine housing, if not both.

To increase the number of positions in which one may secure the machine housing relative to the control disks several peg holes are circumferentially spaced in both the machine housing and the control disks, so that the peg holes provided on the machine housing are spaced differently than the peg holes provided on the control disks. The difference in spacing between the peg holes on the machine housing and those on the control disks provides for a greater number of pivoting positions than would be the case if the spacing between the peg holes were the same on the machine housing and the control disks.

In an alternative embodiment, a full range of positions for securing the machine housing may be achieved by clamping the machine housing in its position relative to the control disks, i.e. the side shields.

DETAILED DESCRIPTION

Figure 1:
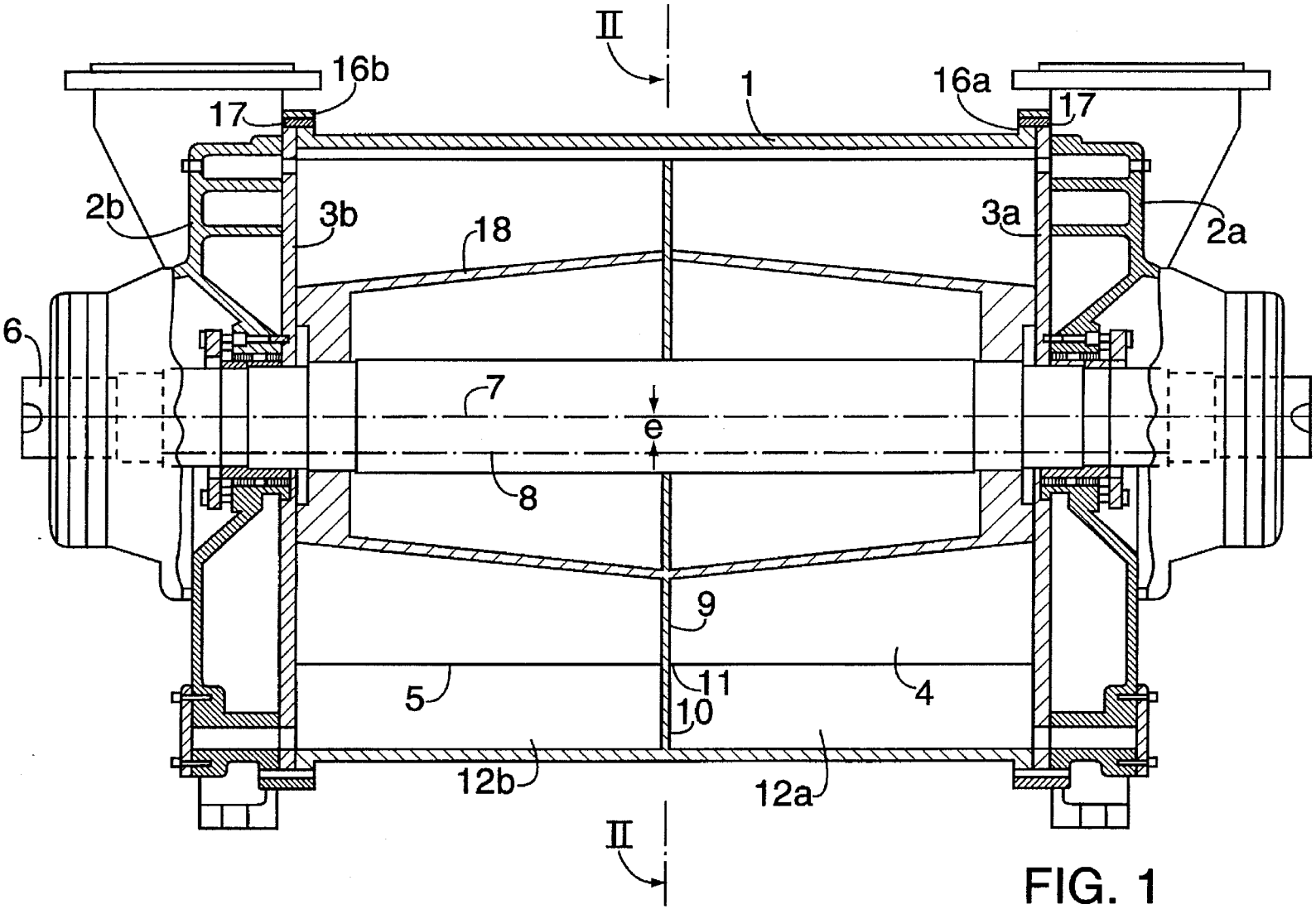
FIG. 1 is a longitudinal cross-sectional side view of a liquid ring machine constructed according to the principles of the invention.

FIG. 1 illustrates the machine housing 1 of a liquid ring machine. The housing has an axially extending, cylindrically symmetrical inner periphery. Side shields 2*a* and 2*b* are arranged at both ends of the machine housing 1, with control disks 3*a* and 3*b* inserted between them and the machine housing 1, respectively. The machine housing 1 is covered at its faces by the control disks 3*a* and 3*b* to define the working space of the liquid ring machine within the machine housing 1. The rotor 5 of the liquid ring machine, which is provided with blades 4, is arranged in this working space. The rotor 5 is mounted in side shields 2*a* and 2*b* via a rotor shaft 6 eccentric to the center axis 8 of the machine housing 1, so that the center axis 7 of the rotor shaft 6 is parallel to and offset from the center axis 8 of the machine housing 1 by the eccentricity dimension e.

Located at the axial midpoint of the rotor 5 is a center wall 9, which extends radially over the entire circumference of the rotor 5 from the rotor hub 18 to the free end of the blades 4. A partition wall 10 which lies in the same plane as the center wall 9 is provided; it circumferentially surrounds the rotor 5 and is affixed to the machine housing 1. A gap 11, which is necessary for operation, exists between the center wall 9 and the partition wall 10. The working space is divided into two partial working spaces 12*a* and 12*b* by means of the center wall 9 and the partition wall 10.

Figure 2:
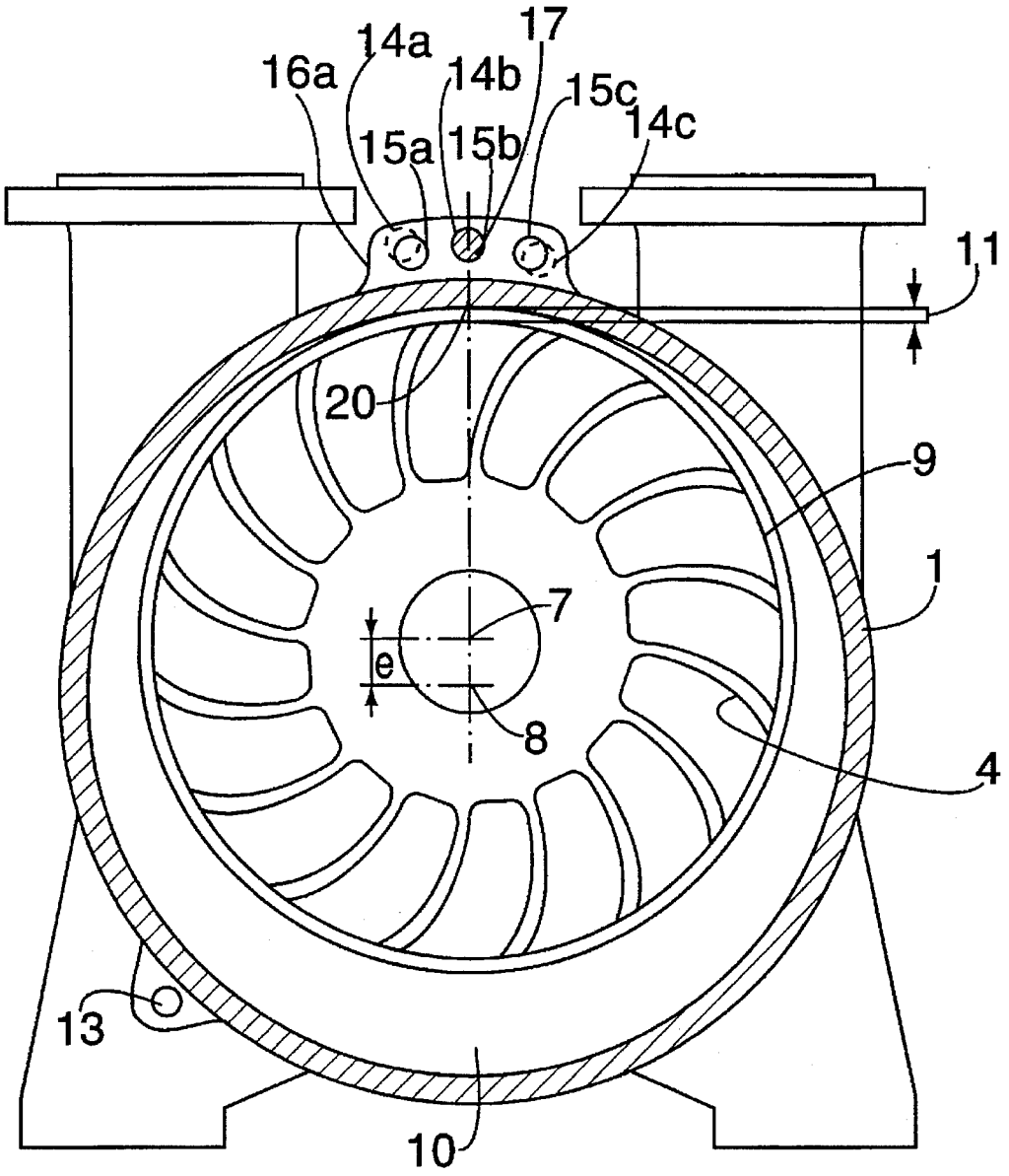
FIGS. 2–4 are cross-sectional views of FIG. 1 along II—II, illustrating the position of the rotor relative to the inside contour of the machine housing in various settings.
Figure 3:
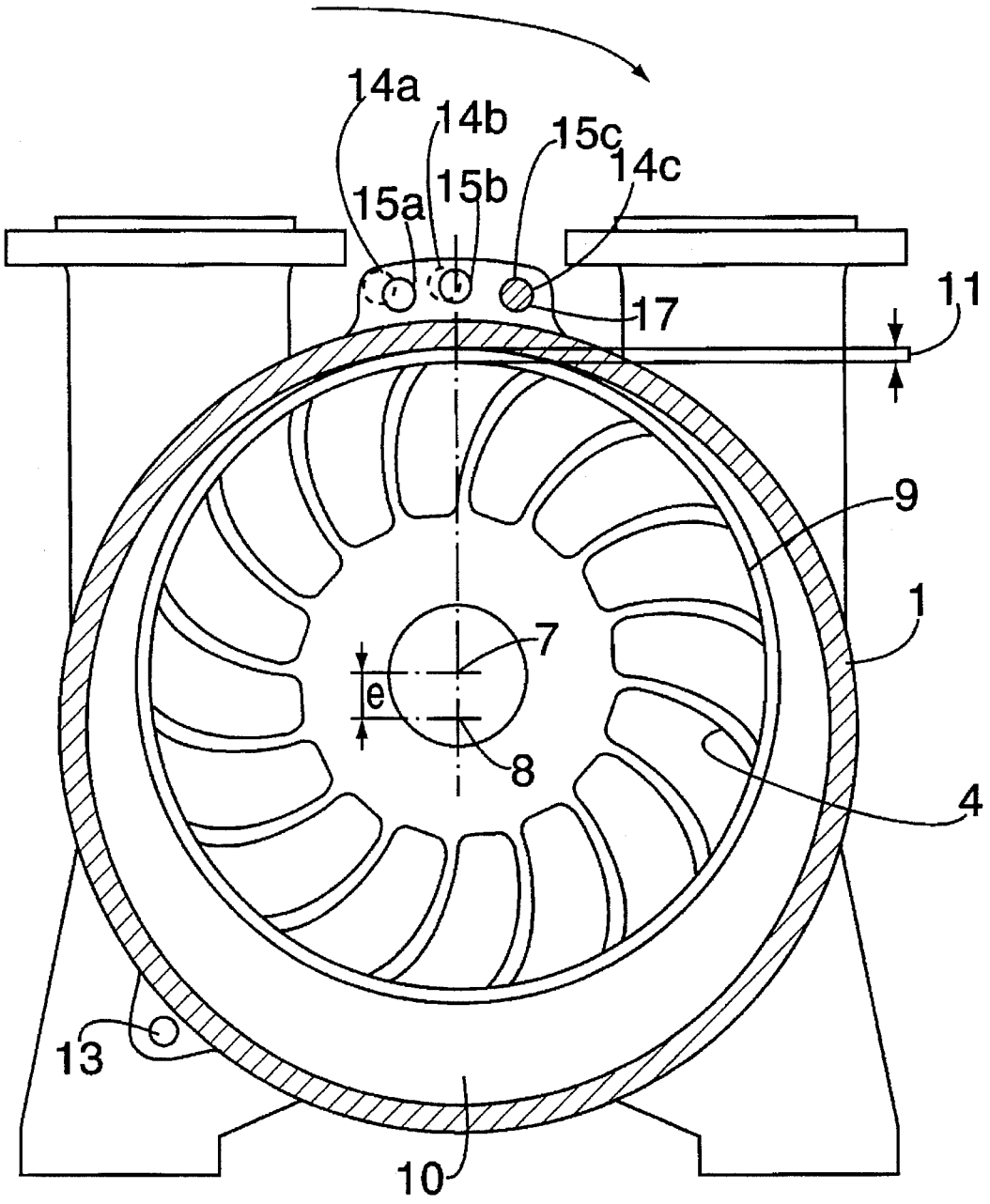
Figure 4:
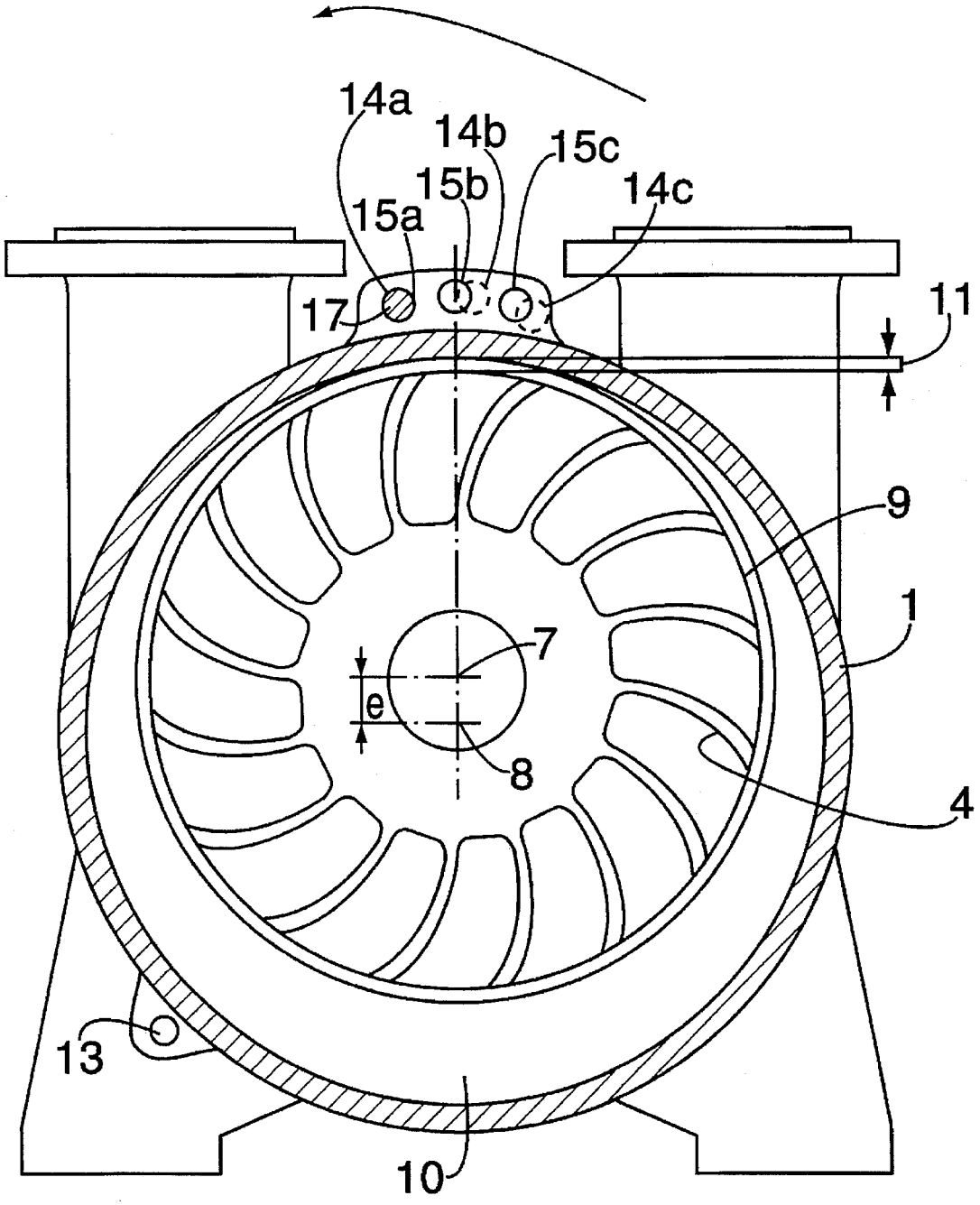

As FIGS. 2 to 4 illustrate, the machine housing 1 is arranged to pivot around a pivot point 13, which lies offset from the center axis 8. To form the pivot point 13, holes are located on the periphery of the side shields 2*a* and 2*b*, control disks 3*a* and 3*b* and machine housing 1 at the designated pivot point 13. An axial pin is inserted through the holes, thus forming the pivot point 13.

To secure the machine housing 1 in a desired pivoted position, peg holes 14*a*, 14*b* and 14*c* are provided in the region of the periphery of the control disk 3*a*, which is not shown in FIGS. 2 to 4. These peg holes may also be provided on control disk 3*b*. Peg holes 15*a*, 15*b* and 15*c* are provided on flange ring 16*a* of the machine housing 1 and correspond to peg holes 14*a*, 14*b* and 14*c* located on control disk 3*a*.

These peg holes are also provided on flange ring 16*b* of machine housing 1 if peg holes are also located on control disk 3*b*. When the machine housing 1 is pivoted around the pivot point 13 at the appropriate pivot angle, peg hole 14*a* is aligned with peg hole 15*a* of the machine housing 1, or peg hole 14*b* is aligned with peg hole 15*b*, or peg hole 14*c* is aligned with peg hole 15*c*. By inserting a pin 17 into peg holes that are aligned, the machine housing 1 can then be fixed in place in the pivoted position in each instance.

The circumferential spacing between peg holes 14*a*, 14*b* and 14*c* on the control disk 3*a* is different from the circumferential spacing between the peg holes 15*a*, 15*b* and 15*c* provided on flange ring 16*a*. This arrangement creates the possibility of pivoting the machine housing by an angle that is different from the angles corresponding to the distance between the peg holes located on flange ring 16*a* and those located on the control disk 3*a*.

Figure 5:
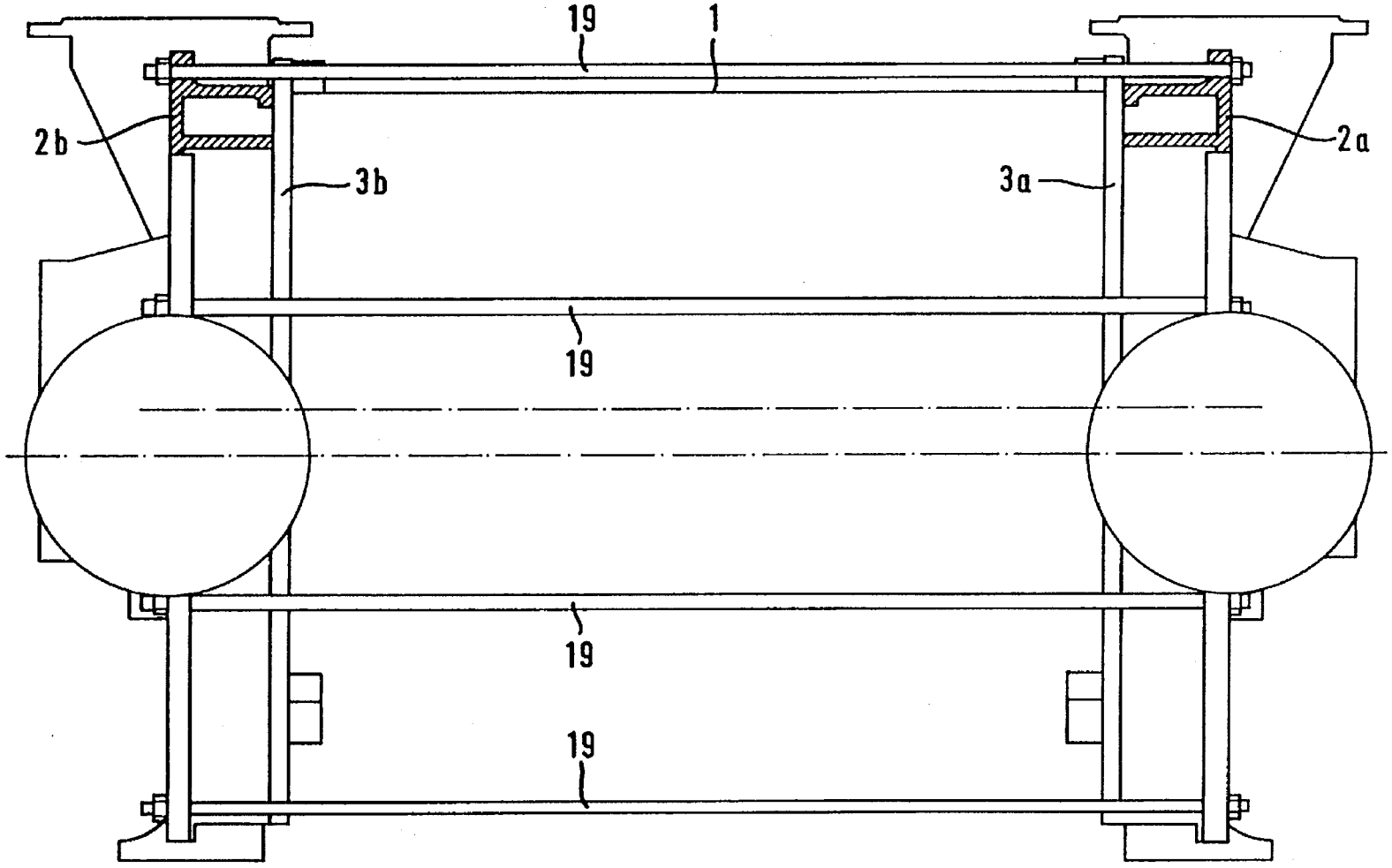
FIG. 5 is a side view, partially in section, illustrating a second embodiment of a portion of a liquid ring machine in which a clamping arrangement is illustrated.

An alternative way to secure the machine housing 1 in its pivoted position relative to the control disks 3*a* and 3*b* is to secure them together with a clamp. (FIG. 5). Before the clamp is secured in place, the machine housing 1 is pivoted with respect to the control disks 3*a* and 3*b* and pivot point 13. As can be seen from FIG. 5, the liquid ring machine is provided with a multiplicity of bolts 19 along its outer circumference. When suitably tightened, the side shields 2*a* and 2*b* are pressed against the machine housing 1 by means of the bolts 19. As a result, the control disks 3*a* and 3*b* are clamped between the side shields 2*a* and 2*b* and the machine housing 1.

The method of adjusting the relative position of the rotor 5 and the machine housing 1 as described is furthermore particularly advantageous for liquid ring machines with a machine housing 1 divided by a partition wall 10. As shown in FIGS. 2 to 4, by pivoting the machine housing 1 around the pivot point 13 which lies outside the center axis 8 of the machine housing 1, a more consistent alteration of the gap 11 between the partition wall 10 and the rotor 5, i.e. its center wall 9, is obtained. Therefore, the corresponding adjustment of the machine housing 1 relative to the rotor 5 can be made without adjustments to the partition wall 10, which means that the partition wall 10 can be affixed to the machine housing 1. Thus, the machine housing 1 and the partition wall 10 may be provided as a unitary element.

The position of the rotor 5 relative to the machine housing 1 as shown in FIG. 2 is referred to as the zero position, since the rotor 5 and the machine housing 1 are aligned with each other in such a way that the gap 11 between the rotor 5 and the partition wall 10 is the same over the entire circumference of the rotor 5. FIG. 3 shows the relative position of the machine housing 1 after it has been rotated in the clockwise direction, and FIG. 4 shows the relative position of the machine housing 1 after it has been rotated in the counterclockwise direction. Although pivoting displaces the vertex 20 of the liquid ring machine, a sufficient gap remains between the rotor 5 and the partition wall 10, so that the rotational movement of the rotor 5 is not hindered and performance is ensured for the two machine halves during operation at different intake pressures.

What is claimed is:

1. A liquid ring machine comprising:

a housing defining a cylindrical liquid working space;

a rotor, said rotor having a circumferential periphery disposed within the housing so that there is a gap between the circumferential periphery of the rotor and the housing;

the housing being movable with respect to the rotor so that the gap can be adjusted; and means for securing the housing in a fixed position with respect to the rotor.

2. A liquid ring machine comprising:

an axially extending machine housing having a longitudinal center axis, the housing having first and second ends;

a side shield affixed to each end of the machine housing;

a control disk located between at least one of the side shields and the machine housing, the machine housing being pivotable with respect to the control disk and the side shields about a pivot point that is offset from the center axis of the machine housing;

a fixation mechanism for securing the position of the machine housing relative to the control disk; and a rotor axially extending through the machine housing along an axis that is offset from the center axis of the machine housing and rotationally mounted in the side shields;

wherein the machine housing may be pivoted about the pivot point with respect to the control disks and the side shields.

3. A liquid ring machine as set forth in claim 2, wherein the machine housing and the control disks have an outer periphery and the fixation mechanism is located on the outer periphery of the machine housing and the control disks such that the machine housing may be secured in a pivoted position relative to the side shields and control disks.

4. A liquid ring machine as set forth in claim 3, wherein the fixation mechanism comprises two or more peg holes located on the machine housing and control disks, and pins which may be introduced into them.

5. A liquid ring machine as set forth in claim 4 in which the fixation mechanism comprises several peg holes circumferentially spaced both on the machine housing and on the control disks with the peg holes provided on the machine housing being spaced differently than the peg holes provided on the control disks.

6. A method for securing a machine housing of a liquid ring machine having side shields and control disks, such that the machine housing is secured in a position relative to the side shields and control disks, the method comprising the steps of:

pivoting the machine housing relative to the side shields and control disks; and fixing the position of the machine housing with respect to the side shields and the control disks.

7. A method for securing a machine housing of a liquid ring machine according to claim 6, wherein the step of fixing the position of the machine housing with respect to the side shields and control disks comprises the step of inserting pins into peg holes, the peg holes being located on the machine housing and control disks.

8. A method for securing a machine housing in a position relative to the side shields and control disks according to claim 6, wherein the step of fixing the position of the machine housing with respect to the side shields and the control disks comprises the step of clamping the machine housing and control disk together.

9. A liquid ring machine comprising:

a machine housing having a longitudinal center axis, the machine housing having first and second ends;

a side shield affixed to each end of the machine housing;

a control disk located between at least one of the side shields and the machine housing, the machine housing being pivotable with respect to the control disk about a pivot point that is offset from the center axis of the machine housing;

a fixation mechanism for securing the position of the machine housing relative to the control disk;

a rotor axially extending through the machine housing along an axis that is offset from the center axis of the machine housing and rotationally mounted in the side shields and comprising a hub and a plurality of blades;

a center wall subdividing the rotor that extends radially over the entire circumference of the rotor from the rotor hub; and a partition wall attached to the machine housing, wherein the partition wall surrounds the center wall and a gap exists between the center wall and the partition wall;

wherein the machine housing may be pivoted about the pivot point with respect to the control disks and the side shields, such that adjustments to the partition wall are not necessary.

10. A liquid ring machine as set forth in claim 9, the machine housing and control disk each having an outer periphery, wherein the fixation mechanism is located on the outer periphery of the machine housing and control disk.

11. A liquid ring machine as set forth in claim 10, wherein the fixation mechanism comprises at least one peg hole located on the machine housing and control disk and at least one pin which may be introduced into the peg holes.

12. A liquid ring machine as set forth in claim 11, in which the fixation mechanism comprises several peg holes circumferentially spaced both on the machine housing and on the control disk, wherein the peg holes provided on the machine housing are spaced differently than the peg holes provided on the control disk.

13. A liquid ring machine as set forth in claim 10, wherein the fixation mechanism comprises a clamp that secures the machine housing in a position relative to the control disk.

14. A liquid ring machine comprising:

an axially extending machine housing having a longitudinal center axis, the machine housing having first and second ends;

a side shield affixed to each end of the machine housing, the machine housing being pivotable with respect to the side shields about a pivot point that is offset from the center axis of the machine housing;

a fixation mechanism for securing the position of the machine housing relative to the side shields; and a rotor axially extending through the machine housing along an axis that is offset from the center axis of the machine housing and rotationally mounted in the side shields;

wherein the machine housing may be pivoted about the pivot point with respect to the side shields.

15. A liquid ring machine as set forth in claim 14, wherein the machine housing and at least one of the side shields have an outer periphery and the fixation mechanism is located on the outer periphery of the machine housing and side shield such that the machine housing may be secured in a pivoted position relative to the side shield.

16. A liquid ring machine as set forth in claim 15, wherein the fixation mechanism comprises one or more peg holes located on the machine housing and at least one of the side shields, and pins which may be introduced into them.

17. A liquid ring machine as set forth in claim 16 in which the fixation mechanism comprises several peg holes circumferentially spaced both on the machine housing and the side shield with the peg holes provided on the machine housing being spaced differently than the peg holes provided on the side shield.

18. A method for securing a machine housing of a liquid ring machine having side shields in a position relative to the side shields comprising the steps of pivoting the machine housing relative to the side shields; and fixing the position of the machine housing with respect to the side shields.

19. A method for securing a machine housing in a position relative to the side shields according to claim 18, wherein the step of fixing the position of the machine housing with respect to the side shields comprises the step of inserting pins into peg holes, the peg holes being located on the machine housing and side shields.

20. A method for securing a machine housing in a position relative to the side shields according to claim 18, wherein the step of fixing the position of the machine housing with respect to the side shield comprises the step of clamping the machine housing and at least one of the side shields together.

21. A liquid ring machine comprising:

a machine housing having a longitudinal center axis, the machine housing having first and second ends;

a side shield affixed to each end of the machine housing, the machine housing being pivotable with respect to at least one of the side shields about a pivot point that is offset from the center axis of the machine housing;

a fixation mechanism for securing the position of the machine housing relative to the side shield;

a rotor axially extending through the machine housing along an axis that is offset from the center axis of the machine housing and rotationally mounted in the side shields and comprising a hub and a plurality of blades;

a center wall subdividing the rotor, said center wall extending radially over the entire circumference of the rotor from the rotor hub; and a partition wall attached to the machine housing, wherein the partition wall surrounds the center wall and a gap exists between the center wall and the partition wall;

wherein the machine housing may be pivoted about the pivot point with respect to the side shields so as to modify the gap, thereby obviating the need for separate adjustments to the position of the partition wall with respect to the machine housing.

22. A liquid ring machine as set forth in claim 21, the machine housing and side shield each having an outer periphery, wherein the fixation mechanism is located on the outer periphery of the machine housing and at least one side shield.

23. A liquid ring machine as set forth in claim 22, wherein the fixation mechanism comprises at least one peg hole located on the machine housing and side shield and at least one pin which may be introduced into the peg holes.

24. A liquid ring machine as set forth in claim 23, wherein the fixation mechanism comprises several peg holes circumferentially spaced both on the machine housing and side shield wherein the peg holes provided on the machine housing are spaced differently than the peg holes provided on the side shields.

25. A liquid ring machine as set forth in claim 22, wherein the fixation mechanism comprises a clamp that secures the machine housing in a position relative to the side shields.

* * * * *